United States Patent [19]

Kuehne

[11] Patent Number: 4,534,984

[45] Date of Patent: Aug. 13, 1985

[54] PUNCTURE-RESISTANT BAG AND METHOD FOR VACUUM PACKAGING BONE-IN MEAT

[75] Inventor: Richard O. Kuehne, Greenville, S.C.

[73] Assignee: W. R. Grace & Co., Cryovac Div., Duncan, S.C.

[21] Appl. No.: 523,807

[22] Filed: Aug. 16, 1983

[51] Int. Cl.[3] ..... B65B 31/02; B65B 25/00; B65D 33/02

[52] U.S. Cl. ..... 426/412; 426/127; 426/129; 426/410; 426/106; 383/109; 383/112; 383/119; 229/DIG. 3; 53/434

[58] Field of Search ..... 426/129, 127, 410, 412; 383/119, 109, 112; 229/DIG. 3, DIG. 14; 53/434

[56] References Cited

U.S. PATENT DOCUMENTS

| | | | |
|---|---|---|---|
| 2,891,870 | 6/1959 | Selby | 426/124 |
| 3,040,968 | 6/1962 | Long et al. | 229/DIG. 3 |
| 3,249,286 | 5/1966 | Palmer | 383/119 |
| 3,264,165 | 8/1966 | Stickel | 428/310 |
| 3,342,613 | 9/1967 | Schelhorn . | |
| 3,494,457 | 2/1970 | Titchenal . | |
| 3,559,800 | 2/1971 | Butler . | |
| 3,625,348 | 12/1971 | Titchenal . | |
| 3,669,256 | 6/1972 | Jacob . | |
| 3,741,253 | 6/1973 | Brax . | |
| 3,819,033 | 6/1974 | Hueber | 229/DIG. 3 |
| 3,832,824 | 9/1974 | Burrell . | |
| 3,928,938 | 12/1974 | Burrell . | |
| 4,120,716 | 10/1978 | Bonet | 156/272 |
| 4,136,205 | 1/1979 | Quattlebaum | 426/129 |
| 4,239,111 | 12/1980 | Conant | 426/124 |
| 4,267,960 | 5/1981 | Lind | 426/129 |

*Primary Examiner*—Steven Weinstein

*Attorney, Agent, or Firm*—John J. Toney; William D. Lee, Jr.; Mark B. Quatt

[57] ABSTRACT

The invention is directed to an improved open-ended flexible plastic container which is adapted to package a meat article having protruding bone sections. In particular, the container comprises a flexible bag preferrably formed from an oriented, i.e. heat shrinkable, and heat sealable plastic material. Since the bag material is susceptible to puncture by bone sections which may protrude from a meat article, one face of at least one side of the bag is provided with a sheet of material which is more resistant to bone puncture than the bag material. The sheet may be adhered on an interior or exterior face of the side of the bag, as desired. The puncture resistant sheet is located on and adhered to the bag in such a manner that it can be aligned with and overlie the protruding bone sections upon insertion of the meat article into the bag. Preferably the sheet of puncture resistant material is smaller in size than the face of the side of the bag to which the sheet is adhered. Additionally, the puncture resistant sheet is provided with at least one line of weakness which allows the puncture resistant sheet to maintain its original alignment with the protruding bone sections of the meat article during a vacuum packaging process.

30 Claims, 10 Drawing Figures

PUNCTURE-RESISTANT BAG AND METHOD FOR VACUUM PACKAGING BONE-IN MEAT

FIELD OF THE INVENTION

The field of the present invention is directed to containers for packaging meat articles having protruding bone sections. In particular, the field of the present invention encompasses heat shrinkable containers which have improved resistance to puncture by said protruding bone sections while also having the capability of readily deforming and uniformly draping and thus conforming to and maintaining the initial alignment of the container with respect to an enclosed meat article during the vacuum packaging process.

BACKGROUND OF THE INVENTION

The use of a heat shrinkable plastic as a flexible packaging material for various food stuffs, including meats, has become commonplace in today's food distribution system. Such plastic materials, however, have been susceptable to puncture by protruding bone sections when used to package meat articles having such protruding bone sections. Thus, these materials have not been as effective as is desirable. The use of cushioning materials such paper, paper laminates, cloth and various types of plastic have proved partially successful in solving the puncture problem.

One particularly successful technique for preventing bone puncture in such plastic containers involves the use of a cloth impregnated with a wax such that, prior to packaging of the meat article, the wax impregnated cloth is selectively placed over the protruding bone sections. Such a process is described in U.S. Pat. No. 2,891,870 to Selby. The purpose of the wax is to facilitate the handling of the cloth during its placement over the bone sections of the meat article prior to packaging. The wax additionally helps to maintain the cloth in the porper position during the actual insertion of the meat article into a plastic bag or other container. While the wax impregnated cloth is quite satisfactory for the function for which it was designed, its use requires the presence of additional packaging personnel on a meat loading and packaging line. Accordingly, due to the increased costs associated with labor, it has become highly desirable from a commercial point of view to modify meat packaging process lines in such a manner that the need for the additional personnel who place the waxed impregnated cloth on the protruding bone sections would be eliminated. For this reason the industry as a whole has, in the past, undertaken the quest of reducing or eliminating the labor costs associated with the placing of impregnated wax cloth over the protruding bone sections.

Many techniques for reducing or eliminating the labor costs have resulted from the industry's quest. In general, the techniques are directed to improving the strength and/or puncture resistance of the bag, pouch or other container which is to package the meat article having protruding bone sections. Additionally, as a result of the increased cost associated with most highly puncture resistant materials, many applications were developed which increased the puncture resistance of the container only in preselected areas. These areas would overlie the protruding bone sections and thus protect the container from puncture without unnecessarily raising the cost of the container through over protection. One such arrangement of this sort is described in U.S. Pat. No. 4,136,205 to Quattlebaum. The container disclosed in that patent incorporates a sheet of material which is more puncture resistant than the material utilized for the bag. The sheet of material is utilized on an interior face of one side of the bag. Another patent which is directed to an improved container in this area is U.S. Pat. No. 4,239,111 to Conant. This patent discloses a flexible pouch with a cross-oriented puncture guard secured to an outer surface thereof. The puncture guard preferably has an area less than that of the bag. The puncture guard preferably includes a plurality of oriented sheets which are laminated in cross-oriented relationship. One disclosed pouch structure comprises a patch formed of a pair of facially juxtaposed, cross-oriented sheets of 2.7 mil thick high density polyethylene.

Other patents which have dealt with this problem are U.S. Pat. Nos. 3,264,165; 3,342,613; 3,494,457; 3,559,800; 3,625,348; 3,669,256; 3,741,253; and 4,267,960.

While all of the above-identified patents do offer some degree of relief from the problems associated with excessive labor costs, some of these configurations, by their very nature, present additional problems which have not yet, heretofore, been overcome. In particular, utilization of a flexible bag having a sheet of more puncture resistant material laminated or adhered to either an interior or exterior face of one side thereof in conventional vacuum chamber processes known to those in the art has resulted in a shifting, movement or misalignment of the sheet of more puncture resistant material away from its original alignment over the protruding bone sections of the meat article. This misalignment of the more puncture resistant sheet occurs as a result of the ballooning the bag undergoes during vacuumizing. The ballooning, which will be discussed in greater detail below, effectively results in the physical displacement of the sheet of more puncture resistant material away from its original position which is in alignment with and in overlieing arrangement to the protruding bone sections. The structure of the prior art containers was such that, upon collapse of the ballooned container, the original alignment of the more puncture resistant material with the protruding bone section was partially or totally destroyed. Therefore, those skilled in the art have been searching for a means to improve the final alignment of the more puncture resistant material with the protruding bone sections without having to increase or incur additional labor costs. The present invention is believed to offer a solution to this problem.

OBJECTS OF THE PRESENT INVENTION

It is thus an object of the present invention to provide an improved puncture resistant container which aids in maintaining the original and proper alignment of a puncture resistant sheet of material which is adhered to a bag or other container with the protruding bone sections of an enclosed meat article.

It is another object of the present invention to substantially reduce container failures caused by the presence of protruding bone sections in meat articles.

It is yet an additional object of the present invention to provide a bag having improved draping characteristics whereby the original alignment of the puncture resistant material in overlieing juxtaposition with the protruding bone sections is substantially maintained throughout the vacuum packaging process.

It is yet a further object of the present invention to provide an improved method for vacuum packaging a meat article having protruding bone sections whereby the final alignment of an adhered sheet of more puncture resistant material, after the step of vacuum packaging, closely approximates the original alignment of the sheet.

Still further objects and the broad scope of applicability of the present invention will become apparent to those of ordinary skill in the art from the details disclosed hereinafter. However, it should be understood that the following detailed description, which indicates several preferred embodiments of the present invention, is only given for purposes of illustration since various changes and modifications well within the scope of the present invention will become apparent to those of ordinary skill in the art in view of the following detailed description. Such changes and modifications are encompassed with the scope of the accompanying claims.

DEFINITIONS

Unless specifically set forth herein and defined or otherwise limited, the terms "polymer" or "polymer resin" as used herein generally include, but are not limited to, homopolymers, copolymers, terpolymers, block and graft polymers, and random and alternating polymers.

The term "barrier" or "barrier layer" as used herein means a layer of a multi-layer film which acts as a physical barrier to gaseous oxygen molecules. Physically, a barrier layer material will reduce the oxygen permeability of a film to less than 70 cc per square meter in 24 hours at one atmosphere, 73° F. and 0% relative humidity. These values should be obtained in accordance with ASTM standard D 1434. A particularly preferred barrier layer composition is a copolymer of a vinylidene chloride and vinyl chloride having 50% or more, by weight, of vinylidene chloride monomer units (i.e. units from vinylidene chloride). A particularly preferred embodiment of such an oxygen barrier material may be obtained under the tradename Saran.

The term "surface" or "surface layer" as used herein means a layer of a multi-layer film which comprises a surface of the film.

The term "internal" or "interior" layer as used herein means a layer of a multi-layer film which is not a surface layer.

The term "intermediate" or "intermediate layer" is used herein refers to an internal layer of a multi-layer film which is located between a barrier layer and a surface layer.

The term "ethylene vinyl acetate copolymer" (EVA) as used herein refers to a copolymer formed from ethylene and vinyl acetate monomers wherein the ethylene derived units (monomer units) in the copolymer are present in major, by weight, amounts and the vinyl acetate derived units (monomer units) in the copolymer are present in minor, by weight, amounts. Preferably the vinyl acetate derived units will represent between 5 and 40 percent, by weight, of the copolymer.

An "oriented" or "heat shrinkable" material is defined herein as a material which, when heated to an appropriate temperature above room temperature (for example, 96° C.), will have a free shrink of 5% or greater in at least one linear direction. Free shrink should be measured in accordance with ASTM D 2732. The terms "orientation", "oriented" and/or "heat shrinkable" also are used herein to describe the process and resultant product characteristics obtained by stretching and immediately cooling a resinous polymeric material which has been heated to its orientation temperature range so as to revise the molecular configuration of the material by physical alignment and extention of the molecules thereof to improve certain mechanical properties of the film. Exemplarary of these properties are shrink tension and orientation release stress. These particular properties may be measured in accordance ASTM D 2838-69 (reapproved 1/9/75). When the stretching force is applied in one direction uniaxial orientation results. When the stretching force is simultaneously applied in two directions biaxial orientation results. In summary, the term "oriented" is herein used interchangably with "heat shrinkable" or "heat shrinkability" with these terms designating a material which has been stretched, oriented and set by cooling while at its stretched dimension. An oriented (i.e. heat shrinkable) material will tend to return to its original unstretched (unextended) dimensions when reheated to within an appropriate temperature range below its melting temperature range. This temperature range is designated by those in the art, as the "orientation temperature range" of a material. Oriented films and methods for accomplishing the orientation thereof are well known by those in the art.

The term "orientation temperature range" or "orientation temperature" as used herein means a temperature range for a given thermoplastic material which is below the melting point of the material and above the secondary transition temperature thereof. Within this range it is easy to effectively orient a plastic material. Orientation temperature ranges for the materials encompassed by the present invention are either known or readily discernable to those of skill in the art.

All compositional percentages used herein are calculated on a "by weight" basis.

A rad is the quantity of ionizing radiation that results in the absorption of 100 ergs of energy per gram of irradiated material, regardless of the source of the irradiation. A megarad is $10^6$ rads. (MR is an abbreviation for megarad).

The term "cross-oriented" as used herein means a multi-layer film or laminate wherein two or more of the layers of the material are oriented in different directions. In other words, the direction of orientation of one layer (i.e. direction of prior stretching) will be at an angle to the direction of orientation of another layer.

The term "heat sealable" material as used herein refers to a thermoplastic material which will seal to itself or another material when subjected to elevated temperature and/or pressure. Heat sealable materials are well known to those in the art.

BRIEF DESCRIPTION OF THE DRAWINGS

FIG. I is a schematic depiction of a process for forming an improved puncture resistant open ended flexible plastic container in accordance with the present invention.

FIG. II is a top plan view of one preferred embodiment of an improved puncture resistant open ended flexible plastic container in accordance with the present invention.

Figure 1:
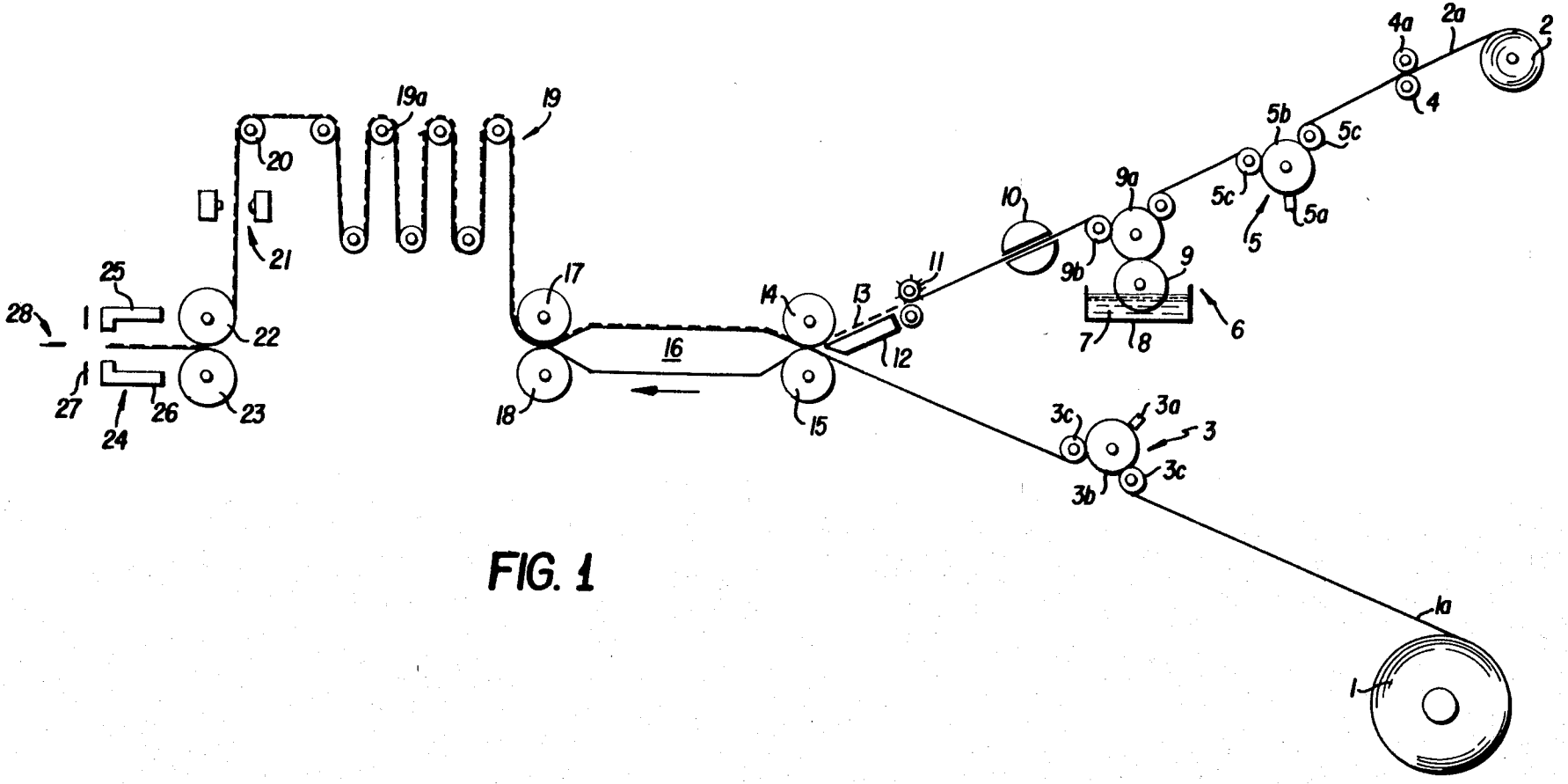
Figure 2:
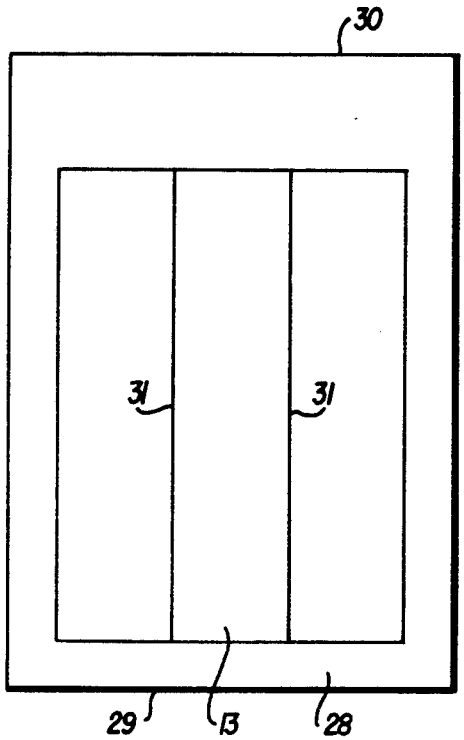
Figure 4:
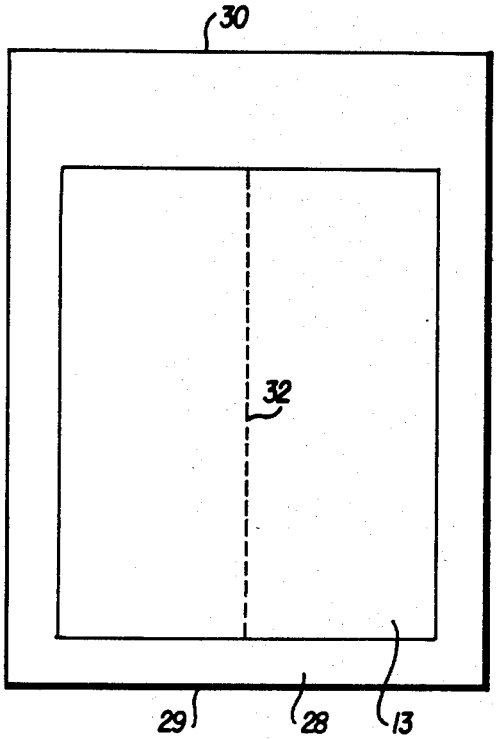
Figure 3:
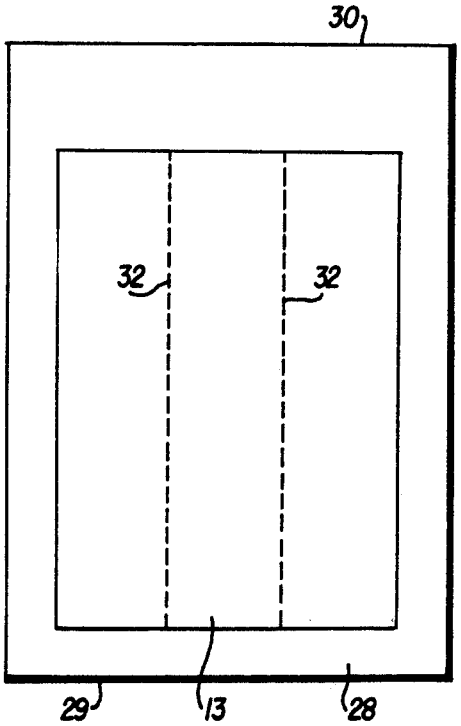
Figure 5:
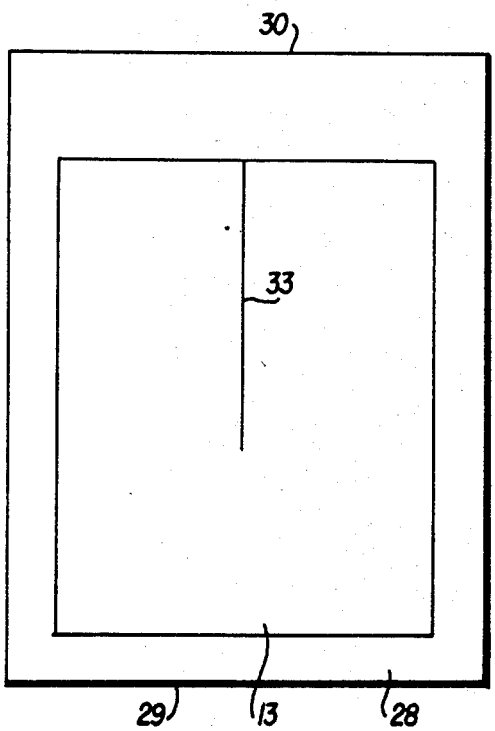
Figure 6:
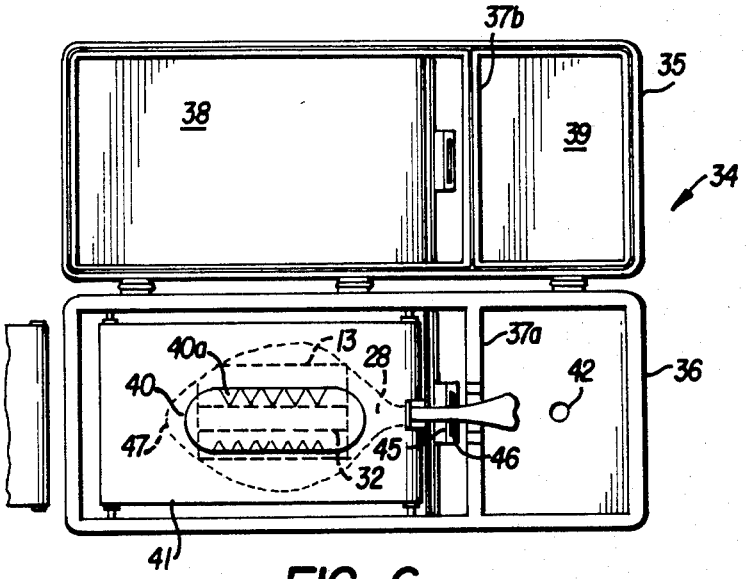
Figure 7:
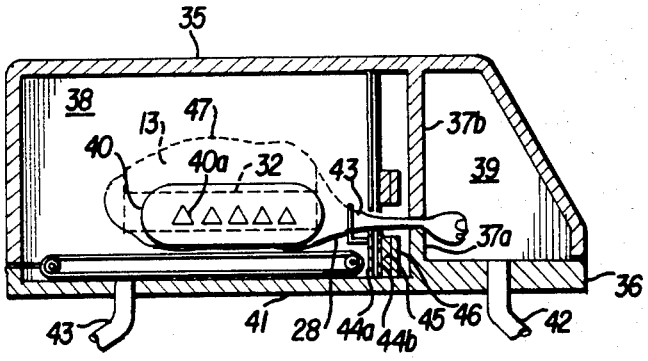
Figure 8:
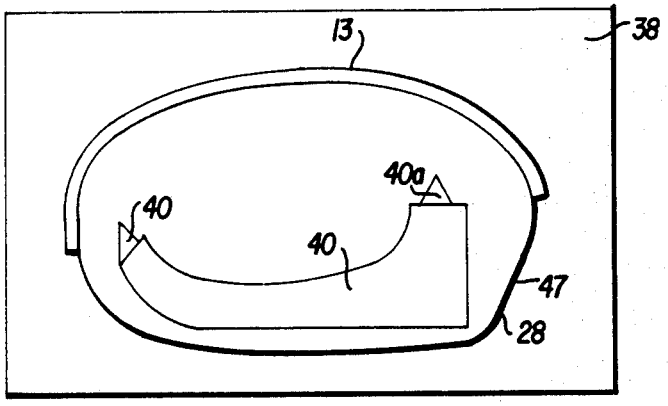
Figure 9:
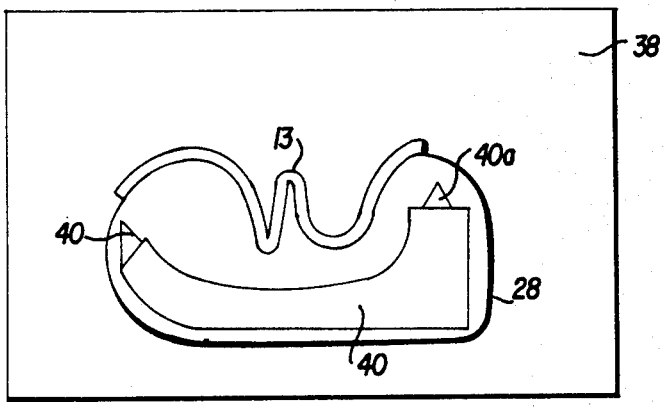
Figure 10:
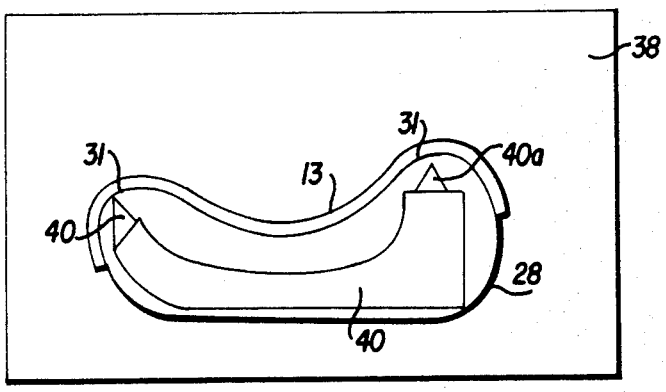

FIG. III is a top plan view of another preferred embodiment of an improved puncture resistant open ended flexible plastic container in accordance with the present invention.

FIG. IV is a top plan view of yet another preferred embodiment of an improved puncture resistant open ended flexible plastic container in accordance with the present invention.

FIG. V is a top plan view of still a further preferred embodiment of an improved puncture resistant open ended flexible plastic container in accordance with the present invention.

FIG. VI is a top plan view of an opened vacuum chamber demonstrating usage of the improved puncture resistant open ended flexible plastic container of the present invention to package a schematic meat article having protruding bone sections.

FIG. VII is a side elevational view of the vacuum chamber of FIG. VI with the side wall of the apparatus cut away so that the interior arrangement may be clearly seen.

FIG. VIII is a schematic view of the interior of the product containing region of the vacuum chamber of FIG. VI. This view shows the ballooning of the container about a schematic meat article having protruding bone sections.

FIG. IX is a schematic view of the interior of the product containing region of the vacuum chamber of FIG. VI. This view shows the misalignment problem associated with the collapsing, during vacuumizing, of prior art bags and other containers having a sheet of puncture resistant material adhered thereto.

FIG. X is a schematic view of the interior of the product containing region of the vacuum chamber of FIG. VI. This view shows the improved collapsing/-draping and conforming capability of the improved puncture resistant container of the present invention.

SUMMARY OF THE INVENTION

The present invention is directed to an improved open ended flexible plastic container which is adapted to package a meat article having protruding bone sections. In particular, the open-ended container comprises a flexible plastic bag having two sides and a closed end with said sides defining an opening into the interior of the bag opposite the closed end or bottom thereof. The bag is preferably formed from a tube of an oriented, i.e. heat shrinkable plastic polymer material. The inner surface of the tube, preferrably, should be heat sealable. Since the bag material is susceptible to puncture by bone sections which protrude from the meat articles, at least one face of one side of the bag is provided with a sheet of material which is much more resistant to puncture. The surface area of the adhered face of the more puncture resistant sheet is less than the area of the face of the side of the bag to which the sheet is adhered. This allows the mouth (open end) of the container to be more easily gathered during clipping or heat sealing of the mouth. The puncture resistant sheet is located on and adhered to the bag in such a manner that it can be aligned with and overlie the protruding bone sections upon insertion of a meat article into the container. A preferred adhesive is a pressure sensitive aqueous acrylic emulsion. Additionally, the puncture resistant sheet is provided with at least one line of weakness which allows the puncture resistant sheet to maintain its alignment with the protruding bone sections of the meat article during vacuum packaging of the meat article in a standard chamber vacuum packaging machines. One particularly preferred embodiment of the present invention comprises a container in which the sheet of more puncture resistant material has been provided with two parallel lines of weakness extending the entire length of the sheet and with the lines of weakness being in the form of serrated lines. Other forms of lines of weaknesses are encompassed by the present invention. In particular, slits, score lines and folds, among others, are envisioned.

DESCRIPTION OF THE DRAWINGS AND PREFERRED EMBODIMENTS

We shall now turn to the drawings wherein like reference numerals represent like structure or process steps and, in particular, to FIG. I which is a schematic representation of a process for manufacturing an improved open ended puncture resistant container embodying the principles of the present invention. Reference numeral 1 represents a wound up lay-flat roll of a flexible tubular material which shall be utilized to form the bag portion of the improved puncture resistant container of the present invention. Manufacture of such tubular material by coextrusion or extrusion coating processes is well known to those of skill in the art. A particularly preferred tubular embodiment is a three layer tubular film comprising a first outer surface layer of an ethylene vinyl acetate copolymer; a second interior oxygen barrier layer comprising a copolymer of vinylidene chloride and vinyl chloride having more than 50%, by weight, of vinylidene chloride derived (monomer) units and a third inner surface layer comprising a cross-linked ethylene vinyl acetate copolymer. Preferably the tubular material has been oriented (rendered heat shrinkable) by means well known to those of skill in the art. Also, preferably the interior surface layer is capable of being heat sealed to itself so that the tube may readily be formed into a bag by means also well known to those in the art. Such a tubular film and its method of manufacture is described in complete detail in U.S. Pat. No. 3,741,253 to Brax et. al. This document is hereby incorporated by reference. Of course the other materials have more or less than three layers may be utilized and this material merely represents a presently preferred material. After leaving roll 1 the unwound lay-flat tubular film travels in lay-flat configuration as indicated at 1*a*. The lay-flat tube 1*a* then passes on to a corona discharge station designated at 3. Station 3 comprises corona discharge unit 3*a* which subjects the upper side of material 1*a* to corona discharge treatment as the material passes about drum 3*b*. Associated guide rollers 3*c* are also included with station 3.

Reference numeral 2 depicts a wound up roll of a flexible material having a greater puncture resistance than that of the tubular film 1*a*. A presently preferred material of this type is a material comprising a plurality of cross-oriented layers. The angle of cross-orientation may be, preferably, 90°. In particular, a preferred material is a cross-oriented sheet of high density polyethylene. Such a material may be obtained from Van Leer Plastics B.V. under the trademark VALeRON®. Preferably, the puncture resistant material 4 has a thickness or gauge of between 3.0 and 5.0 mils. However, other thicknesses are possible. The physical properties (i.e. puncture resistance) of this product vary somewhat with the thickness or gauge of product utilized. In general, the puncture resistance of the Valeron material increases as the thickness of the material increases. Accordingly, the gauge of material to be utilized should be selected with an eye toward the degree of abuse to which the container will be exposed. Of course, any of the many other appropriate puncture resistant materials may be utilized.

Returning to FIG. I, it can be seen that puncture resistant material 2*a* unwinds from roll 2 and thereafter passes between score slitting roll 4 and its associated pinch roll 4*a*. One or more score slitting blades, not shown, are attached to roll 4. Depending on the configuration and number of score slitting blades utilized on roll 4, the material 2*a* may be either completely slit into two or more separate parallel portions or, alternatively, may merely be serrated rather than completely slit. Score slitting rolls and blades are well known to those of skill in the art. Serration of the material 2*a* rather than total slitting may be accomplished by notching the score slitting blades of roll 4 so that the slitting action is not continuous but rather intermittant and produces a serrated line of weakness as opposed to continuously slitting material 2*a*. An additional possibility is that the material 2*a* may be merely scored by its passage between rolls 4 and 4*a*. Such action may be accomplished, as is well known in the art, by allowing a slight gap of space between the score blades of roll 4 and the surface of roll 4*a*. Accordingly, the blades will only score the surface of material 2*a* rather than cutting all the way through and slitting material 2*a*. The slitting or serrating or scoring of the material 2*a* creates a line or lines, as the case may be, of weakness in material 2*a*. These lines of weakness are substantially parallel to the edges of material 2*a* and, when the equipment is operated as described above, they extend entirely along the length of material 2*a*. Of course, if an intermittant line of weakness is desired a mechanism may be added whereby roll 4 and its associated score blades which form the line or lines of weakness, depending on the number of blades, may be moved into and out of contact with sheet 2*a*. Other possible forms of providing a line or lines of weakness in material 2*a* are conceivable and the present invention is not meant to be limited to any particular type of line of weakness. For example, material 2*a* could be creased or otherwise folded by means known to those in the art so as to create a line of weakness. The presently preferred type of line of weakness is a serrated line.

After material 2*a* has been slit, scored, serrated or otherwise provided with a line or lines of weakness the material passes on to a corona discharge station 5 comprised of corona discharge unit 5*a* which subjects the lower side of material 2*a* to corona discharge treatment as the material passes about drum roller 5*b*. Associated guide rollers 5*c* are also included in station 5 which is a substantial equivalent to station 3, discussed above. These two stations 3, 5 subject the lower surface of more puncture resistant film 2*a* and the upper surface lay-flat tubeing 1*a* to corona discharge treatment. These two surfaces are brought into contact with each other at the nip between pinch rolls 14 and 15 as will be hereafter described. Corona discharge treatment of the surface aids in the lamination of material 2*a* to tube 1*a*.

Upon exiting station 5 material 2*a* proceeds to an adhesive coating station generally designated at 6 where an adhesive is coated on to the lower surface of material 2*a*. Preferably, the adhesive is a pressure sensitive adhesive. Pressure sensitive adhesives are well known to those in the art. A particularly preferred pressure sensitive adhesive is an aqueous acrylic emulsion. Of course, other appropriate pressure sensitive adhesives may be utilized. Station 6 comprises a vat or trough 8 which contains adhesive 7. Revolving coating drum 9 is arranged so that the lower surface of puncture resistant material 2*a* contacts drum 9 in the nip between drum 9 and associated revolving drum 9*a*. Drum 9 is positioned so that, during revolution, its surface is immersed in pressure sensitive adhesive 7. Accordingly, adhesive 7 is transfered from vat 8 to the lower surface of material 2*a* by way of drum 9.

After the puncture resistant material 2*a* has been provided with a line or lines of weakness and coated as described above, the material 2*a* is passed over or through a drying oven or other drying means 10 whereby the pressure sensitive adhesive 7 is dried. Means of this sort are well known to those in the art. Thereafter the puncture resistant material 2*a* is cut into discrete patches or individual sheets 13 by the action of cutting rollers at cutting station 11. The discrete patches or sheets 13 are thereafter conveyed by conventional means 12 to the nip between pinch rolls 14 and 15 whereupon they are laminated to the exterior surface of tubular film 1*a* by pressure sensitive adhesive 7 and the combined pressure action of pinch rolls 14 and 15. The puncture resistant patches 13 are thereafter carried along with tubular film 1*a* which thereafter may pass between an additional set of pinch rolls 17 and 18. In one alternative the tubular film 1*a* may be inflated into a bubble 16 in the area between pinch rolls 14, 15 and 17, 18. This inflation, which is not essential, is in order to improve the openability of a finished bag. At this point lay-flat tube 1*a* having patches 13 laminated thereto may be rolled up and stored for future use as a bag forming stock material. Alternatively tube 1*a*, after passing through pinch rolls 17 and 18 whereby it is collapsed back into lay-flat configuration may progress through an inventory station designated generally by 19. Station 19 comprises rollers 19*a* which are relatively moveable in the vertical direction for ensuring that there will always be a supply of tubing available for advancing to the bag forming station 24.

From a final guide roll 20 at the end the inventory assembly 19 the lay-flat tubular film 1*a* still carrying the puncture resistant sheets or patches 13 may, optionally, pass through a photoelectric detector which indicates the repeat length of the material 1*a* for bag formation. Thereafter the lay-flat tube 1*a* is guided through a pair of final pinch rolls 22 and 23 before advancing to a sealing and bag forming station 24. Bag forming station 24 comprises upper and lower sealing jaws 25 and 26 and a bag severing means 27. The combined action of these elements may be arranged, as is well known in the art, such that the leading edge of the tubular material 1*a* is open so as to define the mouth or open end of the bag being formed. (i.e. the bag has its mouth at the left-hand side as viewed in FIG. I). In this case the sealing jaws 25 and 26 and severing means 27 will cooperate to make a seal to bond the opposite edge of a same bag and separate that bag 28 from the open end of the next successive bag. Of course, many other methods of bag formation from a tube are well known to those of skill in the art and any of these methods may be utilized. Furthermore, the bag may be made from a non-tubular matrial as is well known in the art.

Upon completion of the process as outlined in FIG. I many bag 28 structures are possible. Generally the bag 28 will comprise two sides having interior and exterior faces. Additionally the bag 28 will have a closed end 29 and an opening 30 into the interior of the bag opposite said closed end 29. The opening 30 is referred as the mouth of the bag by many individuals. The opening 30 is defined by the sides. Furthermore, the bag of the present invention will comprise at least one sheet 13 of more puncture resistant material adhered to either an interior or exterior face of at least one of the sides. The sheet has an area which is less than the area of the face of the side to which the sheet is adhered. Lastly, the sheet 13 will be provided with one or more lines of weakness. Examplarary structures are illustrated in FIGS. II, III, IV, and V.

FIG. II is a top plan view of a bag 28 formed by the above detailed process wherein the bag 28 comprises a tubular material which has a closed transverse heat sealed bottom 29 and an open-ended mouth 30. A patch or sheet 13 of more puncture resistant material has been adhered to an exterior face of one side of the bag 28. The area of the surface of sheet 13 which is adhered to the exterior face of bag 28 is less than the area said exterior face. This configuration allows the sheet 13 to be maintained at a suitable distance from bag mouth 30. Accordingly, sheet 13 does not interfere with the clipping or heat sealing of bag mouth 30 during closure of the bag 28 by means known to those in the art. The puncture resistant sheet 13 has been provided with two substantially parallel lines of weakness 31 which extend the entire length of puncture resistant patch or sheet 13. In this embodiment the lines of weakness are slits and divide sheet 13 into three substantially equal portions or areas.

FIG. III demonstrates an embodiment where the substantially parallel lines of weakness which extend the entire length of sheet or patch 13 are serrated lines 32.

FIG. IV discloses an embodiment having a single serrated line of weakness 32 which extends the entire length of patch or sheet 13 and divides the puncture resistant sheet into substantially equal halves, portions or areas.

FIG. V discloses an embodiment wherein the single line of weakness is as slit 33 which does not extend the entire length of the puncture resistant patch 13.

Of course, many additional embodiments having different numbers and types of lines of weaknesses will become readily apparent to those of ordinary skill in the art in view of the present disclosure. In particular, the lines of weakness in a given embodiment do not all have to be of the same type. For example, one of the lines of weakness in the embodiment illustrated in FIG. II could be changed to a serrated line of weakness by merely changing the score slitting blade to a notched blade as described above. Furthermore, the location of the lines of weakness can be tailored to the size and shape of particular meat articles to maximize the draping capability of the container during vacuumization as discussed in more detail below.

FIG. VI is a top plan view of one type of a double chamber vacuum packaging apparatus which is now well known to those in the art. In particular, this apparatus and its use is described in detail in U.S. Pat. Nos. 3,832,824 and 3,928,938 both to Burrell. Both of these documents are hereby incorporated by reference. While use of the improved puncture-resistant container of the present invention is hereafter discussed with respect to a double chamber process, such discussion is merely to illustrate one one use of the container and should not be taken as a limitation thereof. In particular, the present container can be utilized with single chamber vacuum chamber machines or, for that matter, many other types of vacuum chamber machines.

In FIG. VI the double chamber vacuumizing apparatus is generally designated at 34 and is shown in top plan representation with the hinged cover or head 35 being open. Also, reference should be made to FIG. VII which is a side elevational representation with the side wall of the apparatus cut away so that the interior arrangement of the vacuum chamber may be clearly seen. The cover 35 is hinged to base member 36 which is divided by lower chamber divider wall 37*a*. Cover 35 is provided with a cooperating divider wall 37*b*. Divider walls 37 separate apparatus 34 into two chambers or regions 38 and 39. The first and larger chamber or region 38 is the product enclosing chamber wherein is located a portion of a bag or receptacle 28 containing an idealized meat article 40 having protruding bone sections 40*a*. The article 40 is placed on a product conveyor 41. The opened end of the container and the container neck is extended into the second and smaller chamber or region 39 which serves as the evacuation chamber for the container or bag. The second chamber 39 may be evacuated through vacuum port 42 and the first chamber 38 may be evacuated through vacuum port 43.

In operation the operator receives a container 28 filled with a product 40 having protruding bone sections 40*a* and places the container on conveyor 41. The operator then assures that patch 13 is in proper alignment with protruding bone sections 40*a*. Thereafter the operator locates the neck of the container 28 in the bag neck guide 43 and extends the neck of the container across walls 44*a* and 44*b*, across plunger housing 45, cutter housing 46 so that the open end or bag mouth of the container extends into the second region or chamber 39 just above the evacuation port 42.

Upon closing of the apparatus evacuation of the first larger chamber or region 38 is accomplished by means of evacuation port 43. Any conventional vacuum pump which is well known to those in the art may be used and may be connected to vacuum port 43 to evacuate chamber 38. As vacuum is applied, the chamber will be evacuated rapidly, in the order of 2–3 seconds to arrive at a low level of pressure of around 27 inches of mercury. Upon such evacuation the bag neck fills the aperture between chambers 38 and 39 formed by the cooperation of upper and lower chamber divider walls 37*a* and 37*b* so that very little air is leaked from the second chamber 39 into the first chamber 38 during this initial phase of evacuation. In this phase of evacuation the bag or container 28 will balloon outwardly as shown by the dotted lines 47. This ballooning is a result of the pressure difference between the interior of the bag 28 which is in communication with chamber 39 and that of evacuated chamber 38. While the container is in the ballooned shape, as designated by the dotted lines 47, evacuation of the second chamber 39 occurs through vacuum port 42. Vacuumization of chamber 39 will usually begin in the order of one half second after the beginning of the evacuation of chamber 38. Chiefly because of the smaller size of chamber 39, the evacuation of second chamber 39 proceeds at a more rapid rate than that of first chamber 38 and soon overtakes the vacuum level in first chamber 38. This action causes the ballooned bag 28 to begin to collapse back into contact with product 40. Thereafter, atmospheric pressure is restored in first chamber or region 38 by stopping the vacuum pumping action through port 43 and venting the chamber to the atmosphere by valve means, not shown. This sudden increase in the pressure differential between the inside and outside of the container will cause the container to collapse rather rapidly and suddenly and therefore drive out any remaining air. Immediately after this action takes place the container is clipped and closed by means well known in the art. Any excess bag material which may exist beyond the clip of the open end may be trimmed off.

This vacuum packaging process is now well known to those skilled in the art and, as stated above, is revealed in even more detail in the above referenced Burrell patents. Unfortunately, when a container or bag having a patch of sheet 13 of more puncture resistant material is utilized in this process problems have occurred.

In particular reference to FIG. VIII which is a schematic cross-sectional view of a schematic meat product 40 having protruding bone sections 40*a* undergoing ballooning action 47 in chamber 38 as described above. FIG. VIII discloses the ballooning 47 which occurs when a container 28 having a patch or sheet of more puncture resistant material 13 is utilized in such an apparatus. As it can be seen from FIG. VIII the more puncture resistant sheet material 13 is properly aligned and located above the sharp protruding bone sections 40*a* of meat article 40. Unfortunately, it has been found that the sudden increase in pressure differential between the inside and outside of the bag which causes the bag or container 28 to collapse creates alignment problems. More particularly, FIG. IX discloses the collapsing action which has been observed when a container having an adhered patch of more puncture resistant material 13 has been utilized in a dual vacuum chamber apparatus as described above. FIG. IX discloses that when the container 28 having a more puncture resistant sheet or patch 13 applied thereto is collapsed the more puncture resistant sheet material 13 tends to bunch up or collapse in the center or hollow of the meat product 40. Accordingly, the edges of the puncture resistant sheet 13 are drawn up and drawn away from their original overlieing juxtaposition with protruding bone sections 40*a*. The net result of this action is that the puncture resistant sheet 13, in many instances, does not overlie the protruding bone section 40*a* and bag 28 remains subject to puncture by the protruding bone section 40*a* in spite of the presence of sheet 13. All of this, of course, is due to the misalignment of the puncture resistant sheet 13 away from the protruding bone sections 40*a* during the vacuumizing process. Furthermore, it should be noted that realignment of the puncture resistant sheet 13 over the protruding bone sections 40*a* is very difficult, if not impossible, after removal of the packaged product from the vacuum chamber since a vacuum exists in the interior of the container. In any event such action would require utilization of extensive manual labor which is to be avoided as stated above.

Accordingly, the present invention is directed to a structure which does not present the difficulties discussed above. This structure has been previously detailed in that the puncture resistant sheet 13 is provided with one or more lines of weakness. Surprisingly, it has been found that when such a structure is utilized in a vacuum chamber the lines of weakness allow the puncture resistant sheet 13 to drape or fold more readily and therefore conform more closely to the meat article which is to be packaged. This action allows the puncture resistant sheet 13 to maintain its original proper overlieing juxtaposition and alignment with protruding bone sections 40*a*. FIG. X demonstrates this capability quite well. In FIG. X the puncture resistant sheet 13 has been provided with two lines of weakness 31 which allow the sheet 13 to drap and collapse very uniformly into good conformity with the meat article during the collapsing and vacuumizing process. Accordingly, the protruding bone sections 40*a* are properly covered by the puncture resistant sheet 13 and the sheet 13 is in position to perform its intended function.

It should be understood that the above detailed description and specific examples which indicate the presently preferred embodiments of the invention are given by way of illustration only since various changes and modifications well within the spirit and scope of the present invention will become apparent to those of ordinary skill in the art in view of the above detailed description and examples. An example of such a modification is that the more puncture resistant sheet 13 may be provided on the interior surface of the container as disclosed in U.S. Pat. No. 4,136,205 to Quattlebaum.

I claim:

1. An open ended flexible plastic container adapted to package a meat article having protruding bone sections, comprising;

a plastic bag comprising two sides and a closed end, said sides defining an opening into the interior of said bag opposite said closed end; and a sheet of a material more puncture resistant than said plastic, one face of said sheet being adhered to one of said sides, said bag being a "lay flat" bag after the sheet of puncture resistant material has been applied thereto; and wherein the surface area of said face is less than the surface area of the side to which said face is adhered, said sheet being located on and adhered to said bag such that it can be aligned with and overlie the protruding bone sections upon insertion of said meat article into said bag, and said sheet is provided with at least one line of weakness along which a fold can be initiated to cause the puncture resistant material to drape and fold readily over said protruding bone sections when a meat article is placed in said bag said line of weakness being sufficient to allow said sheet to maintain its original alignment with the protruding bone sections of said meat article during vacuum packaging.

2. The container of claim 1, wherein said plastic bag is formed from a multi-layer plastic material.

3. The container of claim 2, wherein said multi-layer plastic material comprises a first outer surface layer comprising an ethylene vinyl acetate copolymer; a second interior oxygen barrier layer comprising a copolymer of vinylidene chloride and vinyl chloride; and a third inner surface layer comprising a cross-linked ethylene vinyl acetate copolymer.

4. The container of claim 2, wherein said multi-layer plastic material consists essentially of a first outer surface layer comprising an ethylene vinyl acetate copolymer; a second interior oxygen barrier layer comprising a copolymer of vinylidene chloride and vinyl chloride; and a third inner surface layer comprising a cross-linked ethylene vinyl acetate copolymer.

5. The container of claim 1, wherein said sheet is a laminate comprising two or more cross-oriented layers of a high density polyethylene material.

6. The container of claim 5, wherein said sheet has a thickness of from 3.0 mil to 5.0 mil.

7. The container of claim 1, wherein said sheet is adhered to said side by a pressure sensitive adhesive.

8. The container of claim 7, wherein said pressure sensitive adhesive comprises an aqueous acrylic emulsion.

9. The container of claim 1, wherein said line of weakness comprises a slit.

10. The container of claim 9, wherein said slit runs the entire length of said sheet and divides said sheet into two substantially equal portions.

11. The container of claim 9, wherein said slit runs approximately one half the length of said sheet.

12. The container of claim 1, wherein said line of weakness comprises a serrated line.

13. The container of claim 12, wherein said serrated line runs the entire length of said sheet and divides said sheet into two substantially equal portions.

14. The container of claim 12, wherein said serrated line runs approximately one half the length of said sheet.

15. The container of claim 1, wherein said line of weakness comprises a score line.

16. The container of claim 15, wherein said score line runs the entire length of said sheet and divides said sheet into two substantially equal portions.

17. The container of claim 15, wherein said score line runs approximately one half the length of said sheet.

18. The container of claim 1, wherein said line of weakness comprises a fold.

19. The container of claim 18, wherein said fold runs the entire length of said sheet and divides said sheet into two substantially equal portions.

20. The container of claim 18, wherein said fold runs approximately one half the length of said sheet.

21. The container of claim 1, comprising two or more substantially parallel lines of weakness running the entire length of said sheet.

22. The container of claim 21, wherein said lines of weakness are slits.

23. The container of claim 22, comprising two lines of weakness which divide said sheet into three substantially equal portions.

24. The container of claim 21, wherein said lines of weakness are serrated lines.

25. The container of claim 24, comprising two lines of weakness which divide said sheet into three substantially equal portions.

26. The container of claim 21, wherein said lines of weakness are score lines.

27. The container of claim 26, comprising two lines of weakness which divide said sheet into three substantially equal portions.

28. The container of claim 21, wherein said lines of weakness are folds.

29. The container of claim 28 comprising two lines of weakness which divide said sheet into three substantially equal lines of weakness.

30. In the process for vacuum packaging a meat article having a protruding bone section in a plastic bag with a patch of puncture resistant material adhered to at least one face of the bag, said patch being located on and adhered to said bag such that it can be aligned with and overlie the protruding bone sections upon insertion of said meat article into said bag; said process including the steps of placing said article in said plastic bag, evacuating, sealing, and then shrinking the bag around said article, the improvement which comprises:

(a) providing at least one line of weakness on the patch, the line being parallel to the longitudinal axis of the bag, said line of weakness being sufficient to allow said sheet to maintain its original alignment with the protruding bone sections of said meat article during vacuum packaging;

(b) placing the meat article in the bag with the bone protruding section facing the patch whereby the patch will fold along said line and drape around the bone section; and, (c) evacuating the bag whereby the patch, as the bag is drawn against the meat article, drapes and folds around the meat article with the bone section being covered by the patch.

* * * * *